US006877731B1

(12) United States Patent
Corley, Sr.

(10) Patent No.: US 6,877,731 B1
(45) Date of Patent: Apr. 12, 2005

(54) JOIST CLAMP

(76) Inventor: J. Marlon Corley, Sr., 3706 W. Lawrenceville St., Duluth, GA (US) 30096

( * ) Notice: Subject to any disclaimer, the term of this patent is extended or adjusted under 35 U.S.C. 154(b) by 104 days.

(21) Appl. No.: 10/391,674

(22) Filed: Mar. 18, 2003

(51) Int. Cl.[7] ..... B25B 5/14
(52) U.S. Cl. ..... 269/41
(58) Field of Search ..... 269/41, 3, 6, 228, 269/153, 154, 155, 159, 239, 315

(56) References Cited

U.S. PATENT DOCUMENTS

| | | | | |
|---|---|---|---|---|
| 274,838 | A | 3/1883 | Steineke | |
| 2,770,271 | A | * 11/1956 | Kane | 269/41 |
| 2,929,422 | A | 3/1960 | Tyler et al. | |
| 3,134,573 | A | 5/1964 | Bizjak | |
| 4,165,869 | A | * 8/1979 | Williams | 269/41 |
| 4,305,575 | A | 12/1981 | Bardes | |
| 5,139,231 | A | 8/1992 | Temple | |
| 5,190,266 | A | 3/1993 | Barrera | |
| 5,413,312 | A | 5/1995 | Bobel | |
| 5,527,014 | A | 6/1996 | Bracewell | |
| 5,575,518 | A | * 11/1996 | Payne | 269/41 |
| 5,660,372 | A | 8/1997 | Bobel | |
| 5,826,858 | A | 10/1998 | Gordon | |
| 6,438,854 | B1 | 8/2002 | Kott, Jr. | |

* cited by examiner

*Primary Examiner*—Robert C. Watson
(74) *Attorney, Agent, or Firm*—Hinkle & O'Bradovich, LLC

(57) ABSTRACT

A clamp for holding boards of wood adjacent other boards of wood for nailing, such as in a floor frame is described. The clamp generally includes an elongated body having a lever to open and close a fixed jaw and moveable jaw that are also connected to the body. An arm is connected to the body and to the lever. The jaws generally include teeth to sink into a surface of the wood to secure the wood within the jaws. An end piece includes lips to prevent unwanted movement of the wood as it is held within the jaws. The clamp further includes a tongue that is adapted to overhang other pieces of wood to which ht he board of wood is to be nailed.

14 Claims, 3 Drawing Sheets

JOIST CLAMP

BACKGROUND OF THE INVENTION

I. Field of the Invention

The present invention relates generally to the field of carpentry and construction, and more particularly to a clamping device for holding wood boards, such as joists, planks, studs and the like, in position with other boards to which the boards are to be nailed.

II. Description of the Related Art

During typical construction jobs, two or more boards typically need to be held in place while nailed to other boards. For example, when connecting floor joists to a frame, the joist must be positioned and held in place while the joist is nailed to the frame. The carpenter installing the joist must hold the joist level while nailing it to the frame. Having to hold and nail the joist while keeping the joist level can be difficult and can lead to misplaced joists.

SUMMARY OF THE INVENTION

In general, the invention features a joist clamp for holding a joist in place while it is nailed to another board.

In general, in one aspect, the invention features a clamping apparatus, including an elongated body having a first end and a second end, wherein the first end is a tongue, an end piece having two lips generally perpendicular to the body and being connected to the second end of the body, a fixed jaw connected to the body adjacent the tongue, a moveable jaw connected to the body and an arm having a first end and a second end, the first end being connected to the body adjacent the end piece and the second end of the arm being connected to a lever, wherein the lever is further connected to the moveable jaw.

In one implementation, the fixed jaw is connected to the body through a connection plate that is generally perpendicular to the fixed jaw.

In another implementation, the moveable jaw is pivotally connected to the body through a moveable jaw arm that is pivotally connected to the lever.

In another implementation, the lever includes a main lever portion having a first end and a second end, a short end lever portion connected generally perpendicular to the first end of the main lever portion, a lever pivotal portion connected to the second end of the main lever portion, wherein the lever pivotal portion is pivotally connected to the second end of the arm and is pivotally connected to the moveable jaw arm.

In another implementation, the fixed jaw and the moveable jaw further comprise one or more teeth.

In another implementation, the first end of the arm is pivotally connected to the body.

In still another implementation, the clamp can be in an open position and in a closed position.

In still another implementation, the fixed jaw and the moveable jaw are in opposition and generally parallel when the clamp is in the closed position.

In another aspect, the invention features an apparatus for clamping a board of wood for placement adjacent a second board of wood, including an elongated body, jaws connected to the body, the jaws being adapted to clamp and hold the board of wood, an end piece connected to the body and adapted to prevent unwanted motion of the board of wood when the board of wood is connected and disconnected from the apparatus and a lever connected to the body through an arm and to one of the jaws, the lever being adapted to open and close the jaws to place and remove the board of wood from the apparatus.

In one implementation, the apparatus further includes a tongue adjacent the jaws.

In another implementation, the jaws comprise leading edges that are adapted to align and be flush with an end of the board of wood.

In another implementation, the leading edges and the end of the board of wood are adapted to be positioned against a surface of the second board of wood and wherein the tongue is adapted to rest upon an upper edge of the second board of wood.

In another implementation, the jaws further include teeth to penetrate a surface of the board of wood while the board is held within the jaws.

In another implementation, the elongated body generally contacts the board of wood along the entire length of the body and wherein the tongue overhangs off a leading edge of the board of wood.

In another aspect, the invention features a clamp, including an elongated body, means for holding a board of wood within the clamp, the means for holding the board of wood being connected to the elongated body, means for opening and closing the means for holding the board of wood, the means for opening and closing being connected to the body and to the means for holding the board of wood and means for preventing unwanted motion of the board of wood, the means for preventing unwanted motion being connected to the elongated body.

One advantage of the invention is that it allows "hands-free" nailing because the user installing the board does not have to hold the board while nailing it into place.

Another advantage of the invention is that it allows for faster and more accurate installation of the boards.

Other objects, advantages and capabilities of the invention will become apparent from the following description taken in conjunction with the accompanying drawings showing the preferred embodiment of the invention.

DETAILED DESCRIPTION

The embodiments described herein are referred to as a "joist clamps". It is understood that the embodiments can be used with any type of boards, including but not limited to typical "2×4" (or other sizes) boards, planks, studs and the like.

Figure 1:
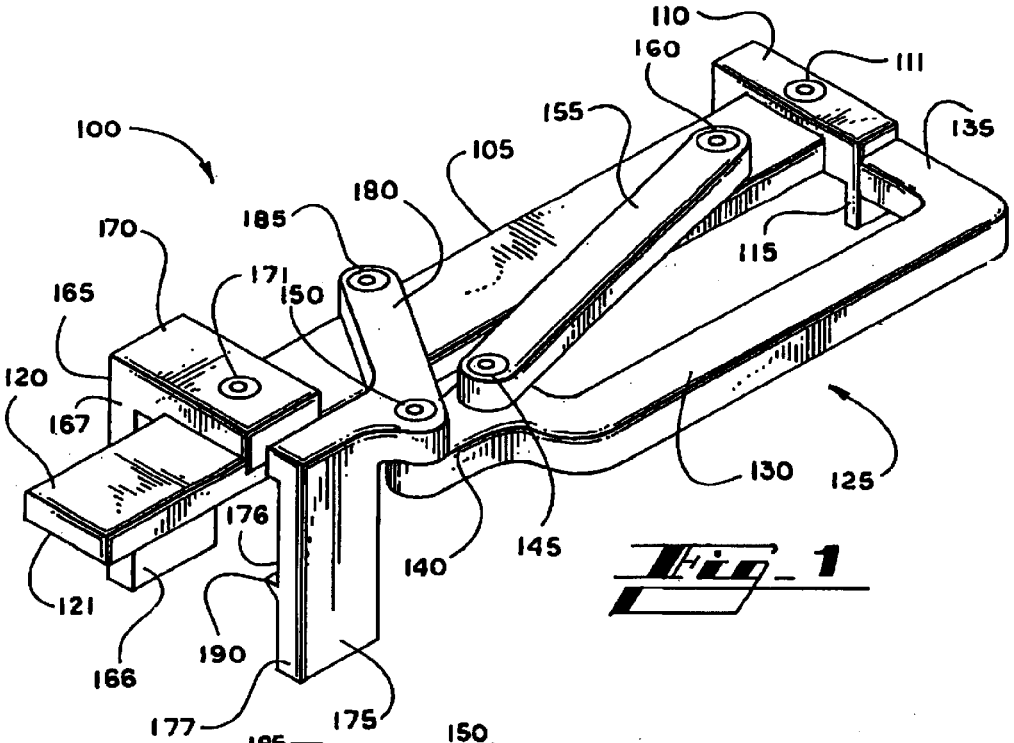
FIG. 1 illustrates a perspective view of an embodiment of a joist clamp in a closed position.

Referring to the drawings wherein like reference numerals designate corresponding parts throughout the several figures, reference is made first to FIG. 1 that illustrates a perspective view of an embodiment of a joist clamp ("clamp") 100 in a closed position. Although there is a wide range of open positions in which the clamp 100 can be placed, two basic positions, an open and closed position, are used to described two general states into which the clamp 100 can be placed. The clamp 100 generally includes an elongated body 105 having two ends. An end piece 110 is connected to one end of the body 105 by a fastener 11. The end piece 110 typically includes two lips 115, of which one lip 115 is shown in FIG. 1. A tongue 120, having an inner face 121, is connected to the other end of the body 105. In a typical embodiment, the tongue 120 is an integral part of the body 105.

The clamp 100 further includes a lever 125. The lever generally includes a main lever portion 130 having two ends. A short end lever portion 135 connected generally perpendicular to one end of the main lever portion 130. The short end lever portion generally contacts the end piece 110 when the clamp 100 is in the closed position. The lever 125 further includes a lever pivotal portion 140 connected to the other end of the main lever portion 130. The lever pivotal portion 140 generally includes two pivot points 145, 150. One pivot point 145 is pivotally connected to one end of an arm 155. The other end of the arm 155 is pivotally connected to the body 105 generally adjacent the end piece 110 at a pivot point 160. The main lever portion 130, the short end lever portion 135 and the lever pivotal portion 140 are typically a single integral piece making up the lever 125.

The clamp 100 further includes a fixed jaw 165 having an inner face 166 and a leading edge 167, the fixed jaw being connected generally perpendicular to a connection plate 170 that is connected to the body 105 by a fastener 171 and adjacent the tongue 120. The fixed jaw portion 165 generally includes teeth (the teeth are shown in the figures below). The fixed jaw 165 and the connection plate 170 are typically a single integral piece. The clamp 100 also includes a moveable jaw 175 having an inner face 176 and a leading edge 177. The moveable jaw 175 is connected to a moveable jaw arm 180 at a generally fixed angle. One end of the moveable jaw arm 180 is connected to the lever pivotal portion 140 at the pivot point 150. The other end of the moveable jaw arm 180 is connected to the body 105 at a pivot point 185. The moveable jaw 175 is generally parallel and in opposition to the fixed jaw 165 when the clamp is in the closed position as shown in FIG. 1. The moveable jaw also includes one or more teeth 190 on the inner face 176 of the moveable jaw 175. The moveable jaw 175 and the moveable jaw arm 180 are typically a single integral piece.

In general, the fasteners 111, 171 and the pivot points 145, 150, 160, 185 can be any variety of suitable fasteners such as rivets, screws, bolts and the like. It is understood that any type of suitable fasteners and pivot point can be used.

Figure 2:
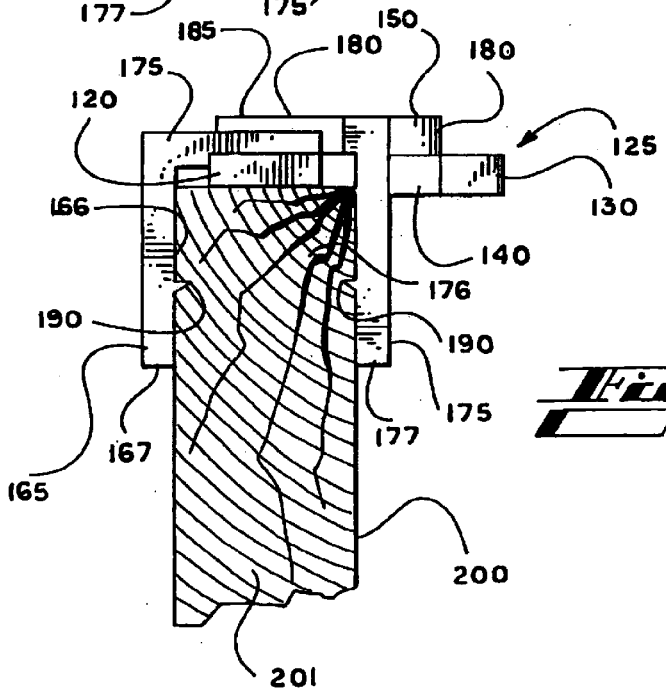
FIG. 2 illustrates a front view of an embodiment of a joist clamp in a closed position and connected to a board of wood.

FIG. 2 illustrates a front view of an embodiment of the clamp 100 in a closed position and connected to a board of wood 200. This front view illustrates that the fixed and moveable jaws 165,175 are arranged in opposition in the closed position. The fixed jaw 165 is connected to the connection plate 170 which is connected to the body adjacent the tongue 120. The moveable jaw 175 is connected to the moveable jaw arm 180 having the two pivot points 150, 185, the pivot point 185 being connected to the body 105. Part of the main lever portion 130 and the lever pivotal portion 140 of the lever 125 are also shown. The inner faces 166, 176 of the jaws 165, 175 are generally in contact with the surfaces of the board 200. The teeth 190 on the respective jaws 165, 175 are sunk (or penetrated) into the surfaces of the board 200. By having the teeth 190 sunk into the plank 200, the clamp 100 is generally more securely attached to the board 200. Typically, the leading edges 167,177 of the jaws 165,175 are generally flush with a leading edge 201 of the board.

Figure 3:
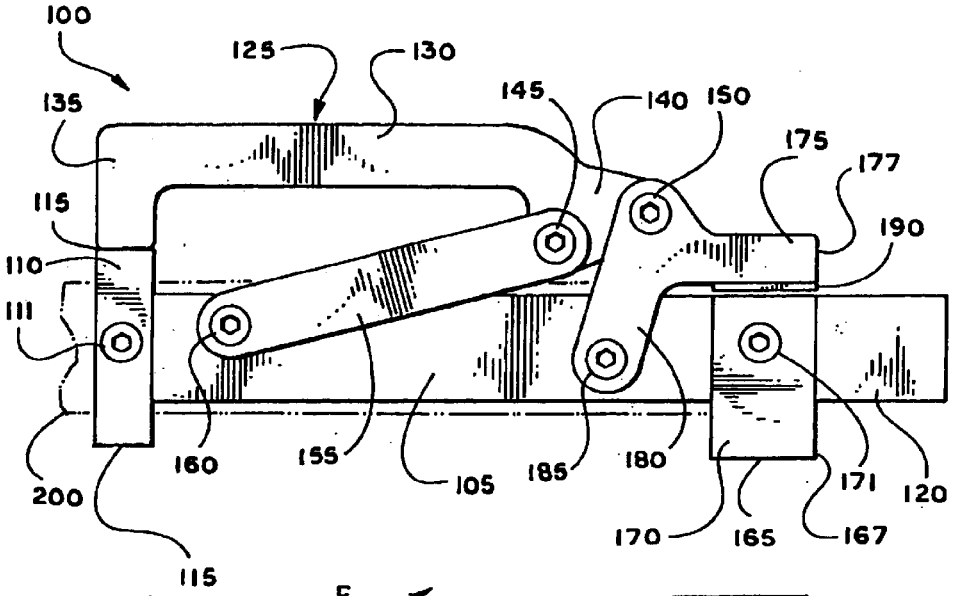
FIG. 3 illustrates a top view of an embodiment of a joist clamp in a closed position and connected to a board.

FIG. 3 illustrates a top view of an embodiment of a joist clamp 100 in a closed position and connected to a board 200. The lever 125 having the main lever portion 130, the short end lever portion 135 connected generally perpendicular to one end of the main lever portion 130 and the lever pivotal portion 140 connected to the other end of the main lever portion 130 is shown. As described above, the short end lever portion 135 generally contacts the end piece 110, having the two lips 115, when the clamp 100 is in the closed position. This contact serves generally to limit the clamping force and motion onto the board 200 as the clamp 100 is put into the closed position as described further below. The tongue 120 being an integral part of the body 105, the arm 155, the fixed jaw 165 and its leading edge 167, connection plate 170, the moveable jaw 175 (including a partial view of a tooth 190) and its leading edge 177, and the moveable jaw arm 180 are also shown. The four pivot points 145, 150, 160, 185 and the fasteners 111, 171 are shown.

Figure 4:
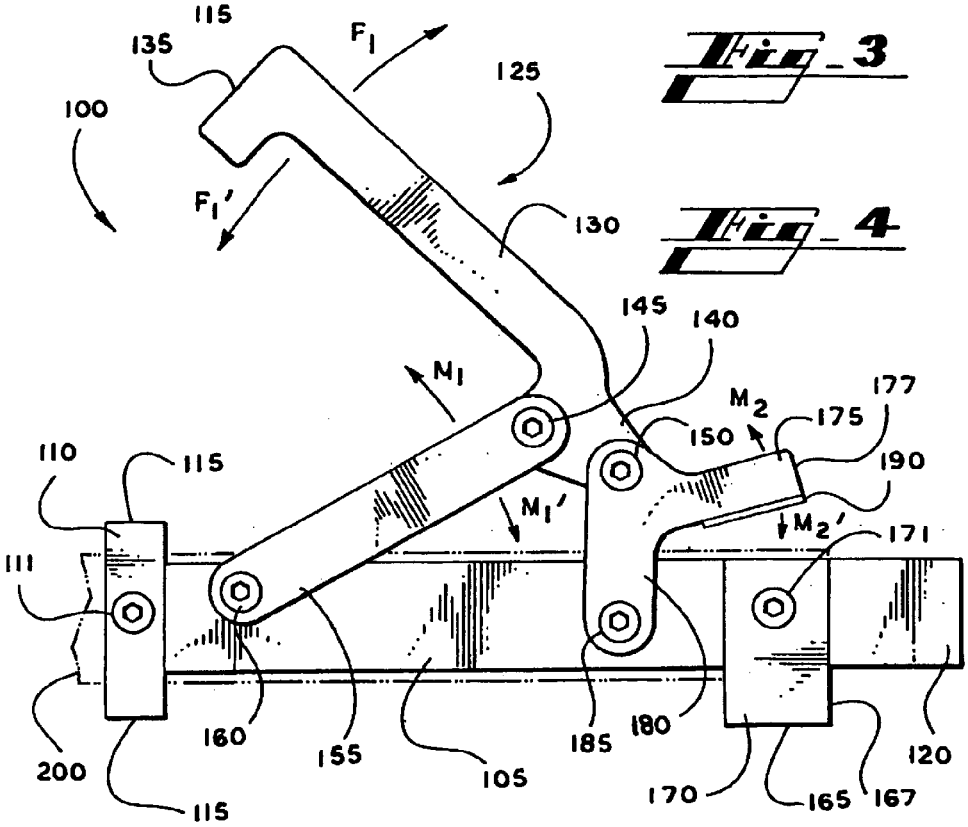
FIG. 4 illustrates a top view of an embodiment of a joist clamp in an open position and adjacent a board.

FIG. 4 illustrates a top view of an embodiment of a joist clamp 100 in an open position and partially connected to and adjacent a board 200. Similar to above in FIG. 3, the lever 125 having the main lever portion 130, the short end lever portion 135 connected generally perpendicular to one end of the main lever portion 130 and the lever pivotal portion 140 connected to the other end of the main lever portion 130 is shown. As described above, the short end lever portion 135 generally contacts the end piece 110, having the two lips 115, when the clamp 100 is in the closed position. This contact serves generally to limit the clamping force and motion onto the board 200 as the clamp 100 is put into the closed position as described further below. The tongue 120 being an integral part of the body 105, the arm 155, the fixed jaw 165 and its leading edge 167, connection plate 170, the moveable jaw 175 (including a partial view of a tooth 190) and its leading edge 177, and the moveable jaw arm 180 are also shown. The four pivot points 145,150,160,185 and the fasteners 111, 171 are shown.

As described above, the clamp typically has a closed position as shown in FIGS. 1–3 and an open position as shown now in FIG. 4. The clamp 100 can be moved through a wide range of open positions as is now described. Starting with the clamp in a closed position for illustrative purposes as in FIG. 3, a user typically can take hold of the lever 125 and pull it to an open position by applying a force on the lever 125 in the direction of arrow F1, which puts the lever 125 in motion in the same direction as arrow F1. The lever 125 pivots about both pivot points 145, 150. More specifically, the lever pivotal portion 140 pivots about the pivot points 145, 150. The pivot points 145, 150 do not typically remain in a fixed position relative to the body 105. In general, as the force F1 is applied to the lever 125, the pivot points 145, 150 shift with respect to each other and with respect to the body 105 as the lever 125 rotates about the pivot points 145, 150. As shown by comparison in FIGS. 3 and 4, the pivot point 145 is closer to the body 105 than the pivot point 150 while the clamp is in a closed position. After, the clamp is placed into an open position, the pivot point 145 is farther away from the body 105 than the pivot point 150. There are a wide range of positions that the pivot points 145, 150 take during the application of the force F1. For example, at one point during the motion, the pivot points are generally both at an equal distance from the body 105. If the lever 125 is raised to its maximum opening, the main lever portion 130 rests against the moveable jaw 175.

As the force F1 is applied, several other components of the clamp 100 are also set into motion. The arm 155 pivots about the pivot point 160 that remains fixed with respect to the body 105. The other end of the arm 155 pivots about the pivot point 145 that moves as described above. The general motion of the arm 155 is in the direction of arrow M1 as the force F1 is applied to the lever 125. Furthermore, the moveable jaw 175 and the moveable jaw arm 180 move as an integral piece generally in the direction M2, pivoting about the pivot point 185 that remains fixed with respect to the body 105.

When the clamp 100 is placed into the open position, the clamp 100 can be removed from the board 200 because the jaws 165, 175 are not clamping the board 200 any longer. While the clamp 100 is in the closed position, the jaws 165, 175 are typically tightly clamped on the board 200 with the teeth 190 sunk into the surfaces of the board 200. In this way, there is little to no relative motion between the clamp 100 and the board 200. However, when the force F1 is applied to the lever 125, the jaws 165, 175 release their hold on the board 200 and there can be resultant relative motion between the clamp 100 and the board. To prevent too much unwanted motion while the clamp 100 is attached and detached from the board, the lips 115 on the end piece 110 generally overhang a portion of the board so as to limit the side to side motion of the board 200 as the clamp is placed.

In order to place the clamp 100 in a closed position with the jaws 165, 175 clamped around the board 200, a force in the direction of arrow F1' is applied on the lever 125, which puts the lever 125 in motion in the same general direction as arrow. F1'. This force F1'sets the arm 155 in a general motion in the direction of arrow M1', and sets the moveable jaw 175 in a general motion in the direction of arrow M2'.

In general, when the board 200 is placed within the jaws 165, 175, the leading edges 167, 177 are aligned with the leading edge 201 of the board 200. This alignment aids in proper placement of the board 200 against another board such as a frame. It is understood that the leading edges 201 of the board 200 may not be exactly flush with the other boards to which the board 200 is to be attached. There may be variances so that the board 200 may be a bit too far spaced from the boards of the frame or fit tightly against the boards of the frame.

Figure 5:
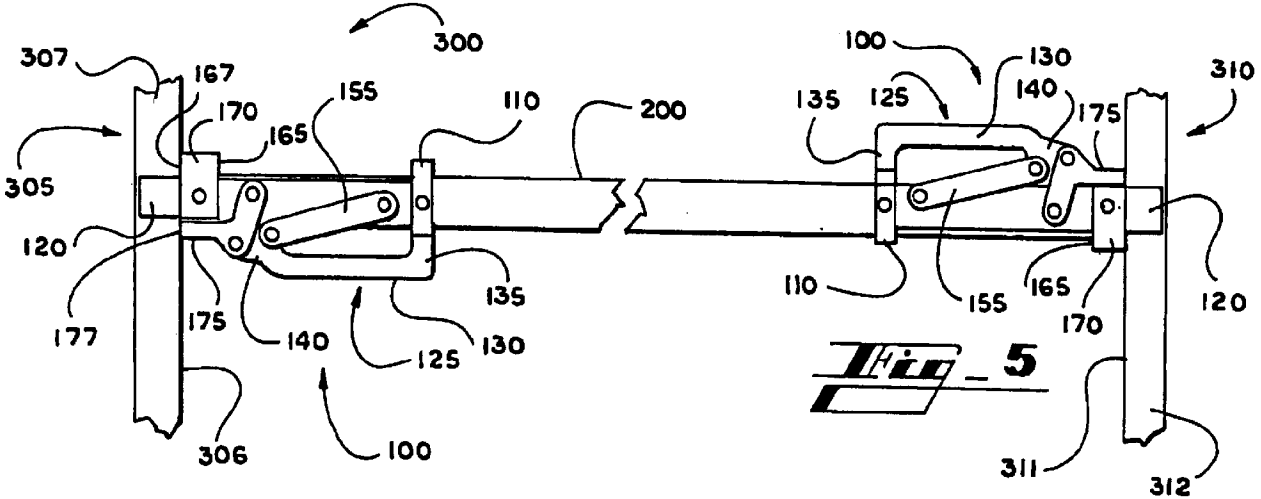
FIG. 5 illustrates a top view of a board positioned adjacent a frame with two embodiments of a joist clamp.

FIG. 5 illustrates a top view of the board 200 positioned adjacent a frame 300 having two side boards 305, 310 (for example, a sill, band or plate) with two embodiments of a joist clamp 100 connected to the board 200 and adjacent the boards 305, 310. The clamps 100 are in a closed position with the short end lever portion 135 of the lever 125 in contact with the end piece 110. The jaws 165, 175 of each of the clamps 100 are closed around the board 200 and the leading edges 167, 177 of the jaws 165, 175 are generally flush with the leading edges of the board 200. Therefore, the leading edges 167, 177 of the clamps 100 as well as the leading edges 201 of the board are generally flush against the respective inner surfaces 306, 311 of the boards 305, 310. The tongues 120 of the clamps 100 rest on the upper surfaces 307, 312 of the boards 305, 310. In this way, the board 200 can be placed on the frame 300 on the respective boards 305,310 without the need from the user to hold the board in place before the user nails the board 200 on the frame 300.

Figure 6:
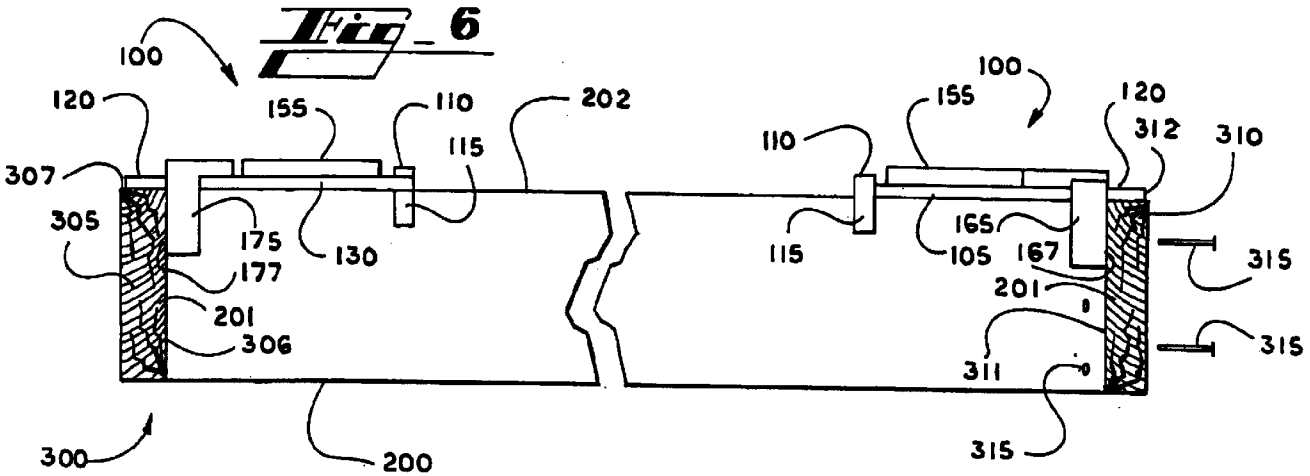
FIG. 6 illustrates a side view of a board positioned adjacent a frame with two embodiments of a joist clamp.

FIG. 6 illustrates a side view of the board 200 positioned adjacent the frame 300 including the two side boards 305, 310, with two embodiments of a joist clamp 100. This view illustrates the tongues 120 resting on the upper surfaces 307, 312 of the boards 305, 310. On the clamp 100 adjacent the board 305, the view illustrates that the leading edge 177 of the moveable jaw 175 is generally flush with the inner surface 306 of the board 305. On the clamp 100 adjacent the board 310, the view illustrates that the leading edge 167 of the fixed jaw 165 is generally flush with the inner surface 311 of the board 310. In addition, the leading edges 201 of the board 200 is flush with the inner surfaces 306, 311. The body 105 generally lies flush on the top edge 202 of the board 200. Therefore, the top edge 202 of the board 200 is generally aligned with the upper surfaces 307, 314 of the boards 305, 310. Furthermore, the legs 115 of the end pieces 110 overhang a portion of the board 200 to limit the unwanted motion of the board 200 as the clamps 100 are attached and detached from the board 200. When the clamps 100 are attached as described above, the board 200 can be hung on the frame 300.

When the board 200 is in a desired position in the frame 300, the user can nail the board 200 into the desired position. Nails 315 are shown on the outer portion of the frame 300 adjacent the board 310 as a possible location to which the nails 315 could be affixed. Nails 320 are also shown on the inner part of the fame 300 adjacent the board 310 as another possible location to affix the nails 315. It is understood that any desired location to affix the nails 315 is contemplated in the embodiments described herein.

Several of the clamps 100 can be combined and used in conjunction together asa kit. Since it is typically desired to use more than one clamp 100 in typical construction jobs, it is desirable to have the clamps 100 combined as a kit.

Furthermore, the embodiments of the clamp 100 described above can be modified to accommodate several different sizes of boards. For example, the space between the jaws 165, 175 and between the legs 115 on the end pieces can be increased or decreased to accommodate different sized of boards.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A clamping apparatus, comprising:

an elongated body having a first end and a second end, wherein the first end is a tongue;

an end piece having two lips generally perpendicular to the body and being connected to the second end of the body;

a fixed jaw connected to the body adjacent the tongue;

a moveable jaw connected to the body; and an arm having a first end and a second end, the first end being connected to the body adjacent the end piece and the second end of the arm being connected to a lever, wherein the lever is further connected to the moveable jaw.

2. The apparatus as claimed in claim 1 wherein the fixed jaw is connected to the body through a connection plate that is generally perpendicular to the fixed jaw.

3. The apparatus as claimed in claim 1 wherein the moveable jaw is pivotally connected to the body through a moveable jaw arm that is pivotally connected to the lever.

4. The apparatus as claimed in claim 3 wherein the lever comprises:

a main lever portion having a first end and a second end;

a short end lever portion connected generally perpendicular to the first end of the main lever portion;

a lever pivotal portion connected to the second end of the main lever portion, wherein the lever pivotal portion is pivotally connected to the second end of the arm and is pivotally connected to the moveable jaw arm.

5. The apparatus as claimed in claim 1 wherein the fixed jaw and the moveable jaw further comprise one or more teeth.

6. The apparatus as claimed in claim 1 wherein the first end of the arm is pivotally connected to the body.

7. The apparatus as claimed in claim 1 wherein the clamp can be in an open position and in a closed position.

8. The apparatus as claimed in claim 7 wherein the fixed jaw and the moveable jaw are in opposition and generally parallel when the clamp is in the closed position.

9. An apparatus for clamping a board of wood for placement adjacent a second board of wood, comprising:

an elongated body;

jaws connected to the body, the jaws being adapted to clamp and hold the board of wood;

an end piece connected to the body and adapted to prevent unwanted motion of the board of wood when the board of wood is connected and disconnected from the apparatus; and a lever connected to the body through an arm and to one of the jaws, the lever being adapted to open and close the jaws to place and remove the board of wood from the apparatus.

10. The apparatus as claimed in claim 9 further comprising a tongue adjacent the jaws.

11. The apparatus as claimed in claim 10 wherein the jaws comprise leading edges that are adapted to align and be flush with an end of the board of wood.

12. The apparatus as claimed in claim 11 wherein the leading edges and the end of the board of wood are adapted to be positioned against a surface of the second board of wood and wherein the tongue is adapted to rest upon an upper edge of the second board of wood.

13. The apparatus as claimed in claim 9 wherein the jaws further include teeth to penetrate a surface of the board of wood while the board is held within the jaws.

14. The apparatus as claimed in claim 9 wherein the elongated body generally contacts the board of wood along the entire length of the body and wherein the tongue overhangs off a leading edge of the board of wood.

* * * * *